US008522890B2

(12) United States Patent
Abe et al.

(10) Patent No.: US 8,522,890 B2
(45) Date of Patent: Sep. 3, 2013

(54) POWER TOOL HAVING LUBRICANT LEAKAGE PREVENTING STRUCTURE

(75) Inventors: Satoshi Abe, Hitachinaka (JP); Takahiro Okubo, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 318 days.

(21) Appl. No.: 12/973,589

(22) Filed: Dec. 20, 2010

(65) Prior Publication Data

US 2011/0155402 A1 Jun. 30, 2011

(30) Foreign Application Priority Data

Dec. 25, 2009 (JP) ..... 2009-294810

(51) Int. Cl.
*B25D 17/26* (2006.01)

(52) U.S. Cl.
USPC ..... 173/48; 173/216

(58) Field of Classification Search
USPC ..... 173/48, 171, 216
See application file for complete search history.

(56) References Cited

U.S. PATENT DOCUMENTS

| | | | | |
|---|---|---|---|---|
| 3,630,293 | A * | 12/1971 | Moores, Jr. | 173/117 |
| 3,685,594 | A * | 8/1972 | Koehler | 173/48 |
| 3,736,992 | A * | 6/1973 | Zander et al. | 173/48 |
| 3,915,034 | A * | 10/1975 | Ward | 475/208 |
| 4,113,035 | A * | 9/1978 | Stiltz et al. | 173/201 |
| 4,183,414 | A * | 1/1980 | Tamai et al. | 173/118 |
| 4,991,472 | A * | 2/1991 | Hollingsworth | 81/464 |
| 5,911,281 | A * | 6/1999 | Treskog et al. | 173/104 |
| 6,043,575 | A * | 3/2000 | Ghode et al. | 310/52 |
| 6,226,877 | B1 * | 5/2001 | Ono | 30/392 |
| 6,543,549 | B1 * | 4/2003 | Riedl et al. | 173/216 |
| 7,401,661 | B2 | 7/2008 | Berghauser et al. | |
| 7,503,402 | B2 | 3/2009 | Ookubo | |
| 2003/0070823 | A1 * | 4/2003 | Kristen et al. | 173/217 |
| 2003/0094293 | A1 * | 5/2003 | Fuchs | 173/171 |
| 2005/0034881 | A1 * | 2/2005 | Berger et al. | 173/2 |

(Continued)

FOREIGN PATENT DOCUMENTS

| | | | |
|---|---|---|---|
| CN | 101253027 | A | 8/2008 |
| CN | 101596709 | A | 12/2009 |

(Continued)

OTHER PUBLICATIONS

Office Action from China Intellectual Property Office for application CN201010615574.1 (Mar. 28, 2013).

(Continued)

*Primary Examiner* — Brian D Nash
(74) *Attorney, Agent, or Firm* — Kilpatrick Townsend & Stockton LLP

(57) ABSTRACT

A power tool includes a housing, an electric motor, a speed change mechanism, and a protrusion member. The housing defines therein a mechanism chamber. A lubricant is inserted in an interior of the mechanical chamber. The electric motor is accommodated in the housing. The speed change mechanism is disposed in the mechanism chamber and connected to the motor for shift-transmitting rotation of the motor. The protrusion member protrudes to the mechanism chamber from the housing in a protrusion direction. The protrusion member provides a communication passage that has one opening open at a leading end side of the protrusion member in the protrusion direction and another opening open to an exterior of the mechanical chamber. At least a part of the protrusion member provides the communication passage and is made from a resilient material.

15 Claims, 6 Drawing Sheets

(56) References Cited

U.S. PATENT DOCUMENTS

| | | | | |
|---|---|---|---|---|
| 2006/0096768 | A1* | 5/2006 | Ookubo | 173/48 |
| 2009/0145617 | A1* | 6/2009 | Duesselberg et al. | 173/48 |
| 2009/0301746 | A1* | 12/2009 | Robieu | 173/217 |

FOREIGN PATENT DOCUMENTS

| | | | |
|---|---|---|---|
| DE | 10217701 | A1 | 11/2003 |
| EP | 1364747 | A2 | 11/2003 |
| GB | 2413300 | A | 10/2005 |
| JP | 1-316178 | A | 12/1989 |
| JP | 2006-130593 | A | 5/2006 |
| JP | 2006-334725 | A | 12/2006 |
| JP | 2008-012664 | A | 1/2008 |
| JP | 2008-036754 | A | 2/2008 |
| JP | 2008-284655 | A | 11/2008 |
| RU | 2311282 | C2 | 11/2007 |
| SU | 1535711 | A | 1/1990 |

OTHER PUBLICATIONS

Japan Patent Office office action for JPO patent application JP2009-294810 (Jul. 29, 2013).

* cited by examiner

POWER TOOL HAVING LUBRICANT LEAKAGE PREVENTING STRUCTURE

CROSS REFERENCE TO RELATED APPLICATION

This application claims priority from Japanese Patent Application No. 2009-294810 filed Dec. 25, 2009. The entire content of each of the priority application is incorporated herein by reference.

TECHNICAL FIELD

The present invention relates to a power tool having a mechanism for transmitting a rotation of an electric motor, and more particularly, to such power tool having a structure for preventing leakage of lubricant.

BACKGROUND

An electronic motor is mounted in the housing of a power tool such as a hammer drill. A cylinder driven by the electric motor is rotatably supported at the leading end of the housing, and an end tool is attached to the leading end of the cylinder. Further, a speed reduction mechanism for changing the rotary speed of the electric motor is provided in the housing. The speed reduction mechanism corresponds to a speed change mechanism. Through the speed reduction mechanism, a rotation of the electric motor is transmitted to the end tool.

The speed reduction mechanism is housed in a mechanism chamber defined by the housing and has a rotation transmission mechanism including a gear and an intermediate shaft. A rotation of the electric motor is transmitted to the intermediate shaft by the gear and then transmitted to the end tool. A bearing is provided within the mechanism chamber at the positions corresponding to both end portions of the intermediate shaft for rotatably supporting the intermediate shaft.

A lubricant is applied to the gear, intermediate shaft, and the like of the speed reduction mechanism for increase in durability and reduction in friction loss. As the lubricant, used is grease containing a metallic soap base such as Ca and Li and an oil component such as silicon oil. The grease has a high fluidity and is soft, so that the lubrication ability of the grease is not impaired even at low temperature environment. The soft grease contains a large amount of oil component. Therefore, a high temperature increases fluidity, with the result that the soap base and oil component tend to be separated from each other. Accordingly, high sealing performance is required for the mechanism chamber in order to prevent the grease from flowing out of the mechanism chamber. In order to realize the high sealing performance, a plurality of types of seal members such as an O-ring, an oil seal, a contact type sealed ball bearing are used for the mechanism chamber. The power tool having the above configuration is disclosed in, for example, laid-open Japanese Patent Application Publication No. H1-316178.

SUMMARY

In a conventional power tool, as described above, different types of seal members are used in individual portions to be sealed to realize a sealing structure of the mechanism chamber. Accordingly, sealing performance differs depending on the individual portions. When the speed reduction mechanism becomes feverish during use of such a power tool, temperature within the sealed mechanism chamber is increased to expand the air inside the mechanism chamber. In this case, if the sealing performance of only one of the above-mentioned different types of seal members is degraded, the expanded air and the grease flow outside of the mechanism chamber through the position corresponding to the seal member whose sealing performance has been degraded. The leakage of the grease may not only degrade quality and durability of the product, but also smear a working area.

There is an available power tool having a conversion mechanism that converts a rotary motion into a reciprocation motion and uses the conversion mechanism to reciprocate a cylindrical piston mounted in the housing. The electrical tool has, in the housing, an impacting power transmission mechanism that reciprocates a striker and intermediate member in accordance with the reciprocation motion of the cylindrical piston to transmit a striking power to the end tool. To this effect, the piston, striker, and intermediate member must be reciprocated at high speed. Therefore, relatively a large amount of grease having high fluidity needs to be put in the mechanism chamber. Further, a heat generated by the high speed reciprocation motion significantly increases pressure in the mechanism chamber. Under the circumstances, the grease whose fluidity has been increased due to the application of the heat easily flowed through the seal position to the outside of the mechanism chamber.

It is therefore, an object of the present invention to provide a power tool that suppresses expansion of the air in the mechanism chamber and prevents the lubricant encapsulated in the mechanism chamber from being leaked outside of the mechanism chamber to thereby increase quality and durability of the tool.

In order to attain the above and other objects, the present invention provides a power tool including a housing, an electric motor, a speed change mechanism, and a protrusion member. The housing defines therein a mechanism chamber. A lubricant is inserted in an interior of the mechanical chamber. The electric motor is accommodated in the housing. The speed change mechanism is disposed in the mechanism chamber and connected to the motor for shift-transmitting rotation of the motor. The protrusion member protrudes to the mechanism chamber from the housing in a protrusion direction. The protrusion member provides a communication passage that has one opening open at a leading end side of the protrusion member in the protrusion direction and another opening open to an exterior of the mechanical chamber. At least a part of the protrusion member provides the communication passage and is made from a resilient material.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
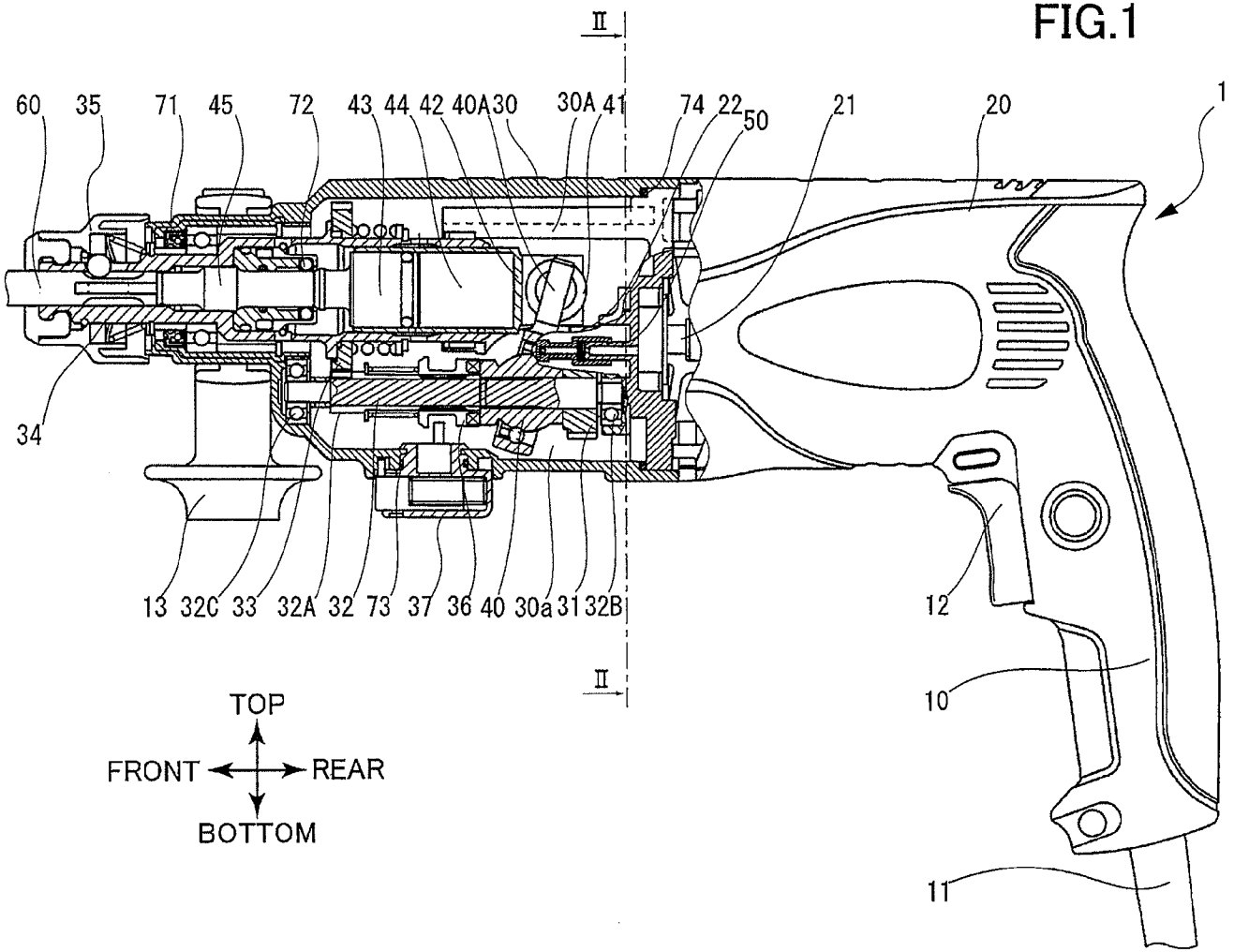
FIG. 1 is a cross-sectional view showing an entire hammer drill according to an embodiment of the present invention.
Figure 2:
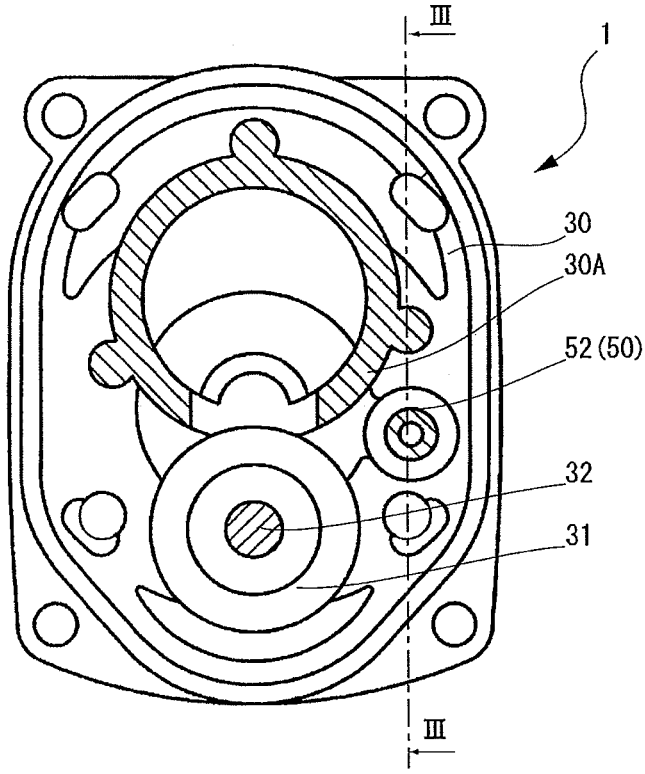
FIG. 2 is a cross-sectional view taken along the line II-II in FIG. 1.

A power tool according to an embodiment of the present invention will be described below with reference to FIGS. 1 to 3. The power tool is, as shown in FIG. 1, a hammer drill 1 including a handle portion 10, a motor housing 20, and a gear housing 30 those constituting a casing. In the following description, a direction in which the handle portion 10 extends from the motor housing 20 will be defined to as a downward direction, while the opposite direction will be defined as a upper direction, and a direction from the motor housing 20 to the gear housing 30 will be defined as a forward direction, while the opposite direction will be defined as a rear direction.

An electric cable 11 is attached to, and a switch mechanism (not shown) is incorporated in the handle portion 10. To the switch mechanism, a user-operable trigger 12 is mechanically connected. The electric cable 11 connects the switch mechanism to an external power supply (not shown). A user operates the trigger 12 to thereby switch connection and disconnection between the switch mechanism and power supply.

The motor housing 20 is provided above the handle portion 10. The inside of the motor housing 20 communicates with an atmosphere. The handle portion 10 and motor housing 20 are integral hard-resin molded product. An electric motor (not shown) is housed in the motor housing 20. The motor housing 20 has an output shaft 21 for outputting a driving force.

The gear housing 30 is a hard-resin molded part provided in front of the motor housing 20. A support member 30A formed from a metal is provided inside the gear housing 30 to partition the gear housing 30 from the motor housing 20. The gear housing 30 and support member 30A define a speed reduction chamber 30*a* which is a mechanism chamber that houses a speed change mechanism to be described later. A portion of the gear hosing 30 and the support member 30A which defines the mechanism chamber corresponds to a mechanism chamber forming portion. The gear housing 30 including the speed reduction chamber 30*a* contains grease serving as lubricant for reducing friction of gears to be described later. The grease is supplied to respective rubbing portions.

In the gear housing 30, an intermediate shaft 32 extending parallel to the output shaft 21 is supported by the gear housing 30 and support member 30A through bearings 32B and 32C so as to be rotatable about the axis of the intermediate shaft 32. The bearings 32B and 32C that support the intermediate shaft 32, each of which is a ball bearing with seal (non-contact type), are provided at both end portions of the intermediate shaft 32 and held by a part of the gear housing 30 and support member 30A. Further, a side handle 13 is provided near a tool holder 35 (to be described later) of the gear housing 30.

A motor pinion gear 22 is provided at the leading end of the output shaft 21. A first gear 31 meshingly engaged with the motor pinion gear 22 is coaxially fixed to the intermediate shaft 32 at the electric motor side. A gear section 32A is formed at the leading end side of the intermediate shaft 32 and is meshingly engaged with a second gear 33 (described later). The support member 30A and the casing constituted by the handle portion 10, motor housing 20, and gear housing 30 define in combination a housing.

A cylinder 34 is provided in the gear housing 30 at the portion above the intermediate shaft 32. The cylinder 34 extends parallel to the intermediate shaft 32 and is rotatably supported by the support member 30A. The second gear 33 is fixed to the outer circumference of the cylinder 34. The meshing engagement between the second gear 33 and gear section 32A allows the cylinder 34 to be rotated about an axis of the cylinder 34.

The above-mentioned tool holder 35 is provided at the leading end side of the cylinder 34 for detachably holding an end tool 60. The support member 30A thus supports the motor pinion gear 22, intermediate shaft 32, and cylinder 34, so that a higher mechanical strength is required for the support member 30A as compared to the gear housing 30 and motor housing 20. Therefore, the support member 30A is made from a metal.

A clutch 36 that is biased by a spring in the direction toward the electric motor is splined to the middle portion of the intermediate shaft 32. The clutch 36 can be switched, by a change lever 37 provided at the lower portion of the gear housing 30, between hammer drill mode (position shown in FIG. 1) and drill mode (the clutch 36 is moved to the position on the leading end side of the intermediate shaft 32). A motion conversion section 40 that converts a rotary motion into a reciprocation motion is rotatably disposed over the intermediate shaft 32 at the portion on the electric motor side of the clutch 36. The motion conversion section 40 corresponds to the speed change mechanism. The motion conversion section 40 has an arm portion 40A reciprocally movable in the longitudinal direction of the hammer drill 1 by the rotation of the intermediate shaft 32.

At the time when the clutch 36 is positioned at the hammer drill mode through the change lever 37, the clutch 36 connects the intermediate shaft 32 to the motion conversion section 40. The motion conversion section 40 is connected to a piston 42 provided in the cylinder 34 through a piston pin 41 so as to operate simultaneously with the piston 42. The piston 42 is reciprocally movably disposed within the cylinder 34 in the direction parallel to the intermediate shaft 32 in a sliding manner with respect to the cylinder 34. A striker 43 is installed in the piston 42, and an air chamber 44 is defined in the cylinder 34 and between the piston 42 and striker 34. An intermediate member 45 is supported in the cylinder 34 at the portion on the opposite of the air chamber with respect to the striker 43 so as to be slidable in the moving direction of the piston 42. The end tool 60 is located at the portion on the opposite side of the striker with respect to the intermediate member 45. The striker 43 therefore strikes the end tool 60 through the intermediate member 45.

A rotation output of the motor is transmitted from the motor pinion gear 22 to the intermediate shaft 32 through the first gear 31. The rotation of the intermediate shaft 32 is then transmitted to the cylinder 34 through the meshing engagement between the gear section 32A and second gear 33 disposed over the cylinder 34. Thus, the end tool 60 is rotated. When the clutch 36 is shifted to the hammer drill mode through the change lever 37, the clutch 36 is connected to the motion conversion section 40 to transmit the rotation of the intermediate shaft 32 to the motion conversion section 40. The motion conversion section 40 allows the piston pin 41 to convert the rotation into a reciprocation motion of the piston 42. The reciprocation motion of the piston 42 causes the air in the air chamber 44 defined between the striker 43 and piston 42 to be repeatedly compressed and expanded, thereby imparting a striking force to the striker 43. The striker 43 then moves forward to butt the rear end surface of the intermediate member 45 and the striking force is transmitted to the end tool 60 through the intermediate member 45. As described above, in the hammer drill mode, the rotation force and striking force are simultaneously imparted to the end tool 60.

At the time when the clutch 36 is shifted to the drill mode, the clutch 36 disconnects the connection between the intermediate shaft 32 and motion conversion section 40 to allow the rotation of the intermediate shaft 32 to be transmitted to the cylinder 34 through the gear section 32A and second gar 33. Accordingly, in the drill mode, only the rotation is imparted to the end tool 60.

The speed reduction chamber 30*a* that is defined by the gear housing 30 and houses the rotation transmission mechanism is sealed by a plurality of types of seal members. These seal members prevent the grease from being leaked outside the gear housing 30.

More specifically, an oil seal 71 is provided between an outer peripheral surface of the cylinder 34 and gear housing 30, an O-ring 72 is mounted to an inner peripheral surface of the cylinder 34 that supports the intermediate member 45, and an O-ring 73 is mounted at the connection portion between the change lever 37 and gear housing 30. Further, an O-ring 74 is mounted at the connection portion between the support member 30A and gear housing 30. A bearing (not shown) that supports the motor pinion gear 22 is formed by a sealed ball bearing (contact type) and contributes to the sealing of the speed reduction chamber 30*a*.

As shown in FIG. 1, a pressure adjusting mechanism 50 is provided on the support member 30A. The pressure adjusting mechanism 50 is located in substantially the middle portion between the intermediate shaft 32 and cylinder 34 and is located on the right side of the support member 30A as viewed from the end tool 60 side toward the support member 30A as shown in FIG. 2. The pressure adjusting mechanism 50 corresponds to a protrusion member.

Figure 3:
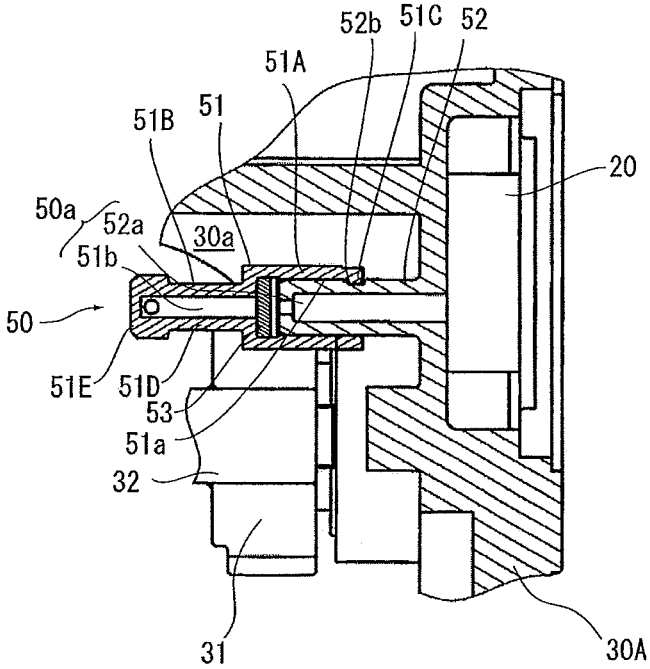
FIG. 3 is a detailed cross-sectional view taken along the line in FIG. 2.

As shown in FIG. 3, the pressure adjusting mechanism 50 mainly includes a first passage forming component 51, a second passage forming component 52, and a filter 53 and extends frontward in the speed reduction chamber 30*a*. The pressure adjusting mechanism 50 is in a cantilever shape and adjusts a pressure in the speed reduction chamber 30*a*.

The first passage forming component 51 is located at the leading end side of the pressure adjusting mechanism 50 and is made from rubber material. The rubber material is used as one example of a resilient material. The first passage forming component includes a mounted section 51A and an extending section 51B. The mounted section 51A is in a cylindrical shape and is formed with a holding space 51*a*. An inner diameter of the holding space 51*a* is substantially equal to or slightly smaller than an outer diameter of the second passage forming component 52. The leading end portion of the second passage forming component 52 is inserted into the holding space 51*a*. Since the inner diameter of the holding space 51*a* is substantially equal to or slightly smaller than the outer diameter of the second passage forming component 52, the second passage forming component 52 inserted in the holding space 51*a* is attached firmly to the inner surface of the mounted section 51A that forms the holding space 51*a*, thereby preventing the second passage forming component 52 from disengaging from the holding space 51*a*. Since the second passage forming component 52 is attached firmly to the mounted section 51A, leakage of the grease and the air to the outside from between the second passage forming component 52 and the mounted section 51A can be prevented. A click portion 51C protruding toward the holding space 51*a* is provided on the mounted section 51A at the rear end thereof.

The extending section 51B is located at the front side of the mounted section 51A and has an outer diameter that is smaller than that of the mounted section 51A such that the extending section 51B is in a constriction shape with respect to the mounted section 51A. The extending section 51B includes a constriction portion 51D extending from the front end of the mounted section 51A, and a head portion 51E located on the front end of the constriction portion 51D. The head portion 51E has an outer diameter larger than that of the constriction portion 51D. A first passage 51*b* is formed on both of the constriction portion 51D and the head portion 51E. The first passage 51*b* includes a front opening formed on the peripheral wall part of the head portion 51E to permit the first passage 51*b* to communicate with the speed reduction chamber 30*a*, and a rear opening to permit the first passage 51*b* to communicate with the holding space 51*a*. An area of the first passage 51*b* between the front opening and the rear opening extends in the front-to-rear direction. Hence, the first passage 51*b* has a bending section at a region between the front opening that opens to the speed reduction chamber 30*a* and a position where the first passage 51*b* enters the constriction portion 51D.

The second passage forming component 52 is in a cylindrical shape and is integrally provided on the gear housing 30 to protrude toward the speed reduction chamber 30*a*. A second passage 52*a* is formed on the second passage forming component 52. The second passage 52*a* includes a front opening that is located at the front end of the second passage 52*a* and opens frontward, and a rear opening that opens to the inside of the motor housing 20. Since the mounted section 51A is mounted on the front end portion of the second passage forming component 52, the second passage 52*a* communicates with the holding space 51*a*. Further, since the inside of the motor hosing 20 communicates with the atmosphere, the second passage 52*a* also communicates with the atmosphere. A depressed portion 52*b* with which the click portion 51C is engaged is provided on an outer circumferential surface of the cylindrical portion of the second passage forming component 52. The click portion 51C and the depressed portion 52*b* provide an engagement portion. The disengagement of the first passage forming component 51 from the second passage forming component 52 can be restrained by the engagement portion.

The filter 53 made from a felt having air permeability is located on the holding space 51*a* in a state where the first passage forming component 51 is mounted on the second passage forming component 52. The filter 53 separates the first passage 51*b* and the second passage 52*a* from each other. Accordingly, an air flowing between the first passage 51*b* and the second passage 52*a* can be filtered by the filter 53. The first passage 51*b*, the second passage 52*a*, and the filter 53 define a communication passage 50*a*.

Drilling operation using the hammer drill 1 will be described. When performing drilling using the hammer drill 1, a user firstly holds the side handle 13 and handle portion 10 with both hands and pulls the trigger 12. Thus, an electrical power is supplied to the motor to drive the motor. The motive energy of the motor is transmitted by the rotation transmission mechanism including the motor pinion gear 22, first gear 31, intermediate shaft 32, gear section 32A, second gear 33, and the like to the end tool 60 as a rotation force. Although the friction loss of the driving force is reduced since the grease is supplied to the respective gears, a slight friction occurs and the friction is converted into heat energy to generate heat. Further, the rotation force is converted into a reciprocation force through the motion conversion section 40 to allow the piston 42 and intermediate member 45 to generate striking force. In this case, the air is compressed in the air chamber 44 in the piston 42 to generate heat of compression, and a part of kinetic energy by the impact of the striker 43 against the intermediate member 45 is converted into heat energy to generate heat.

These heat generation factors heats the inside of the gear housing 30, with the result that the encapsulated grease becomes feverish. The grease becomes feverish, thereby increasing its fluidity. Further, since the air exists in the gear housing 30, the volume of the air is expanded when the gear housing 30 is heated. Air-tightness is secured at the respective seal portions, so that the heated and expanded air is discharged to the atmosphere through the communication passage 50*a* permitting communication between the speed reduction chamber 30*a* and the atmosphere.

Since the fluidity of the grease in the gear housing 30 is increased, it is likely that the grease is adhered to the first passage forming component 51 and enters into the communication passage 50*a* through the front opening of the first passage forming component 51. However, since the first passage forming component 51 is made from rubber material and has the constriction shape, the first passage forming component 51 vibrates like a pendulum by vibrations generated from the driving of the gears and the like and the reciprocation motion of the piston 42. A position where the first passage forming component 51 is mounted on the second passage forming component 52 is served as a fulcrum for the vibration of the first passage forming component 51. The front opening of the communication passage 50*a* (the first passage forming component 51) that opens to the speed reduction chamber 30*a* is formed on the leading end section of the first passage forming component 51 having the constriction shape. The position at which the front opening is formed is the most vibrating position in the first passage forming component 51. Hence, even if the grease is adhered to near the front opening of the first passage forming component 51 by increasing the fluidity of the grease due to the application of the heat in the drilling operation, the adhered grease is shook off from the first passage forming component 51 due to the vibration of the first passage forming component 51 caused by the vibration in the drilling operation. Accordingly, the entering of the grease from the front opening of the communication passage 50*a* to inside thereof can be avoided.

The heated air in the gear housing 30 contains grease component. Since the filter 53 is provided on the communication passage 50*a*, the grease component is trapped by the filter 53 when the air containing grease component is entered into the filter 53. Therefore, the leakage of the grease component to the atmosphere can be avoided After stopping operation of the hammer drill 1, the speed reduction chamber 30*a* and the like are subjected to natural cooling to cool the internal air, resulting in the reduction in the volume of the air. As a result, the speed reduction chamber 30*a* assumes a negative pressure to allow the outside air to flow into the speed reduction chamber 30*a* through the filter 53 and communication passage 50*a*. At this time, the grease component adhered to the filter 53 can be given back into the speed reduction chamber 30*a* together with the outside air. As a result, clogging of the filter 53 hardly occurs and, therefore, the filtration capability of the filter 53 can be maintained over prolonged period of time.

Figure 4:
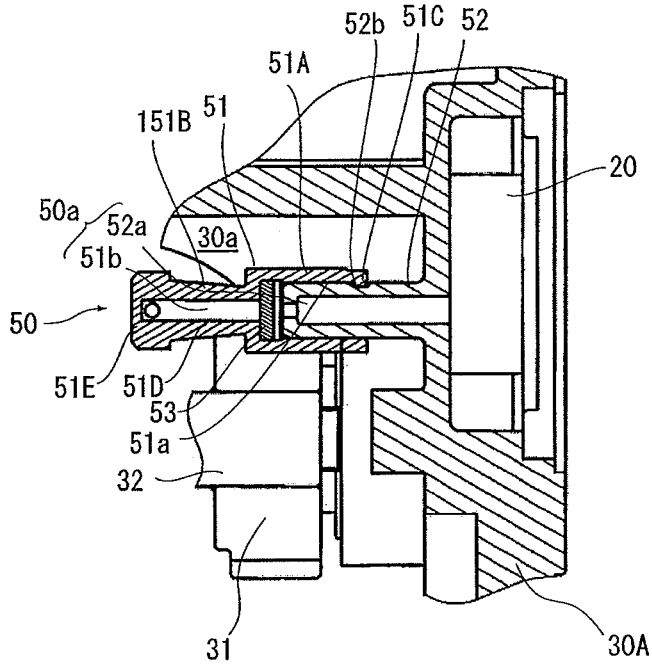
FIG. 4 is a cross-sectional view of an essential portion of a hammer drill according to a first modification to the embodiment of the present invention.

While the invention has been described in detail and with reference to specific embodiments thereof, it would be apparent to those skilled in the art that various changes and modifications may be made therein without departing from the spirit and scope of the invention. For example, as shown in FIG. 4, an extending section 151B may be in a substantially conical shape. That is, a cross-section perpendicular to a direction in which the extending section 151B extends from the mounted section 51A, of the extending section 151B has an outer diameter that gradually increases toward the leading end side (front side) of the extending section 151B.

With this structure, a fulcrum portion for the vibration in the first passage forming component 51 becomes thinner than the leading end portion of the first passage forming component 51 and a weight of the leading end portion of the first passage forming component 51 is increased. Hence, the grease adhered to the first passage forming component 51 can be shook off in more certainty. Further, the extending section 151B may be in a pyramidal shape, instead of the conical shape. If the extending section 151B is in the pyramidal shape, a vibration direction of the extending section 151B can be defined.

Figure 5:
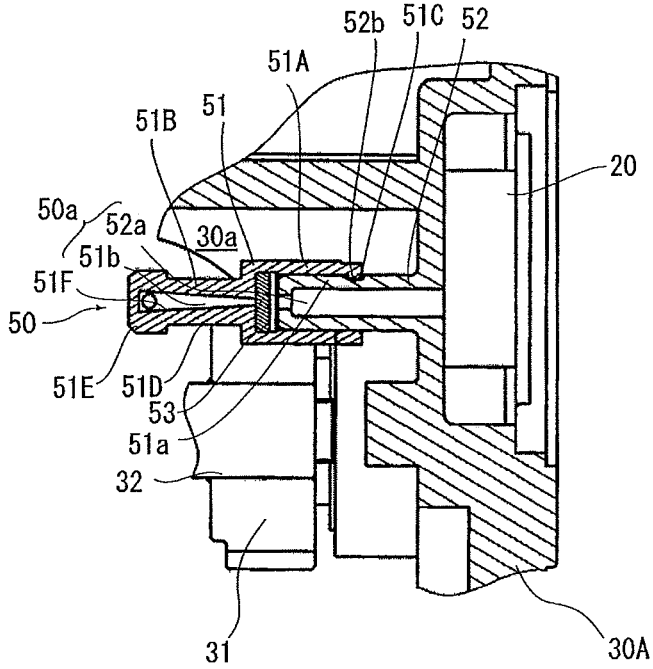
FIG. 5 is a cross-sectional view of an essential portion of a hammer drill according to a second modification to the embodiment of the present invention.

As shown in FIG. 5, the first passage forming component 51 has a first inner wall surface 51F that defines the first passage 51*b*. The first inner wall surface 51F may be configured such that the inner diameter of the first passage 51 gradually increases toward the leading end side (front side) in a protruding direction of the pressure adjusting mechanism 50.

With this structure, the first inner wall surface 51F has an ascending slope section from the front side to the second passage forming component 52 side (rear side). Accordingly, if the grease enters the communication passage 50 and is adhered to the inner wall surface 51F, the movement of the grease from the first passage 51*b* to the second passage 52*a* can be restrained.

Figure 6:
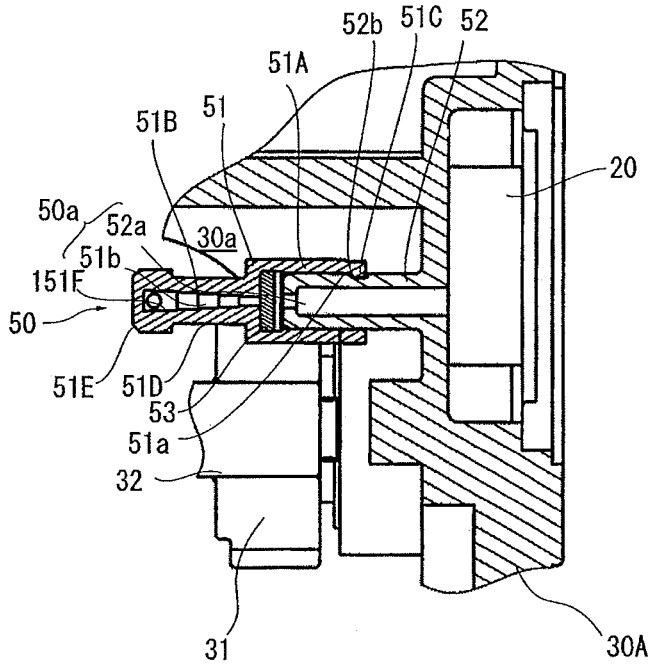
FIG. 6 is a cross-sectional view of an essential portion of a hammer drill according to a third modification to the embodiment of the present invention.

As another configuration of the first inner wall surface having the rising slope, as shown in FIG. 6, a first inner wall surface 151F may have a stepped portion rising from the first passage forming component 51 side to the second passage forming component 52 side. With this structure, the grease that moves toward the second passage 52*a* on the first inner wall surface 151F is blocked by the stepped portion of the first inner wall surface 151F, thereby preventing the grease from moving from the first passage 51*b* to the second passage 52*a* more certainly.

Figure 7:
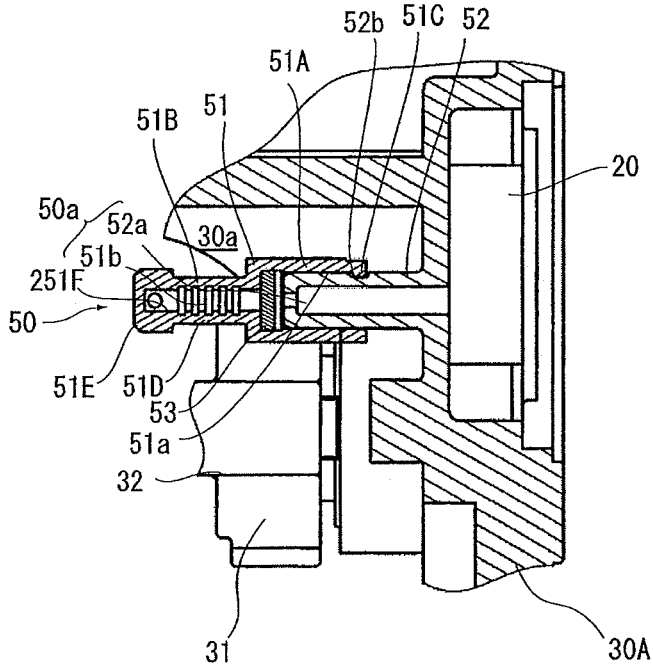
FIG. 7 is a cross-sectional view of an essential portion of a hammer drill according to a fourth modification to the embodiment of the present invention.

As shown in FIG. 7, the first inner wall surface 251F may have a concave/convex portion having annular projections and annular recesses alternately arrayed from the front opening to rear opening of the first passage 51*b*.

With this structure, if the grease enters the communication passage 50 (the first passage 51*b*) and is adhered to the inner wall surface 51F, the movement of the grease to the second passage forming component 52 can be prevented by the concave/convex portion. Further, the grease adhered to the inner wall surface 51F mostly remains in the concave portion. Hence, even if the grease is adhered to the inner wall surface 51F, the reduction of the cross-sectional area of the first passage 51*b* can be avoided. Accordingly, the reduction of the air passage section of the communication passage 50*a* can be restrained, thereby stabilizing the pressure in the pressure reduction chamber 30*a*. Note that, the concave/convex portion may be formed on an inner wall (second inner wall surface) that defines the second passage 52*a*, instead of or in addition to the first inner wall surface 51F.

Figure 8:
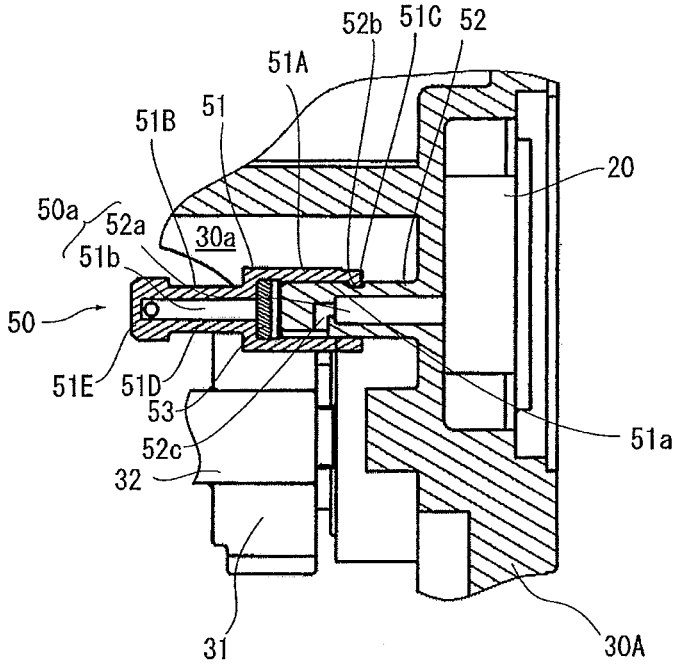
FIG. 8 is a cross-sectional view of an essential portion of a hammer drill according to a fifth modification to the embodiment of the present invention.

As shown in FIG. 8, the second passage 52*a* may includes a bending passage 52*c* at the open portion of the second passage 52*a* that communicates with the first passage 51*b*. The bending passage 52*c* opens to a direction perpendicular to a direction from the first passage 51*b* to the second passage 52*a*. The bending passage 52*c* opens to a downside at the side surface part and the vicinity of the leading end of the second passage forming component 52. A gap is formed between the vicinity of the leading end of the second passage forming component 52 and the inner surface of the mounted section 51A that defines the holding space 51*a*.

With this structure, the communication passage 50*a* has a bending section at a boundary between the filter 53 and the second passage 52*a*. Even if the grease absorbed in the filter 53 flows to the second passage 52*a* side due to grease saturating in the filter 53, the grease collides against the bending section of the bending passage 52*c* and flows on the surface of the bending section. Hence, the leakage of the grease to the outside can be delayed. The delay effect can be improved by increasing the number of bending times. The bending section may be formed on the first passage 51*b*.

Figure 9:
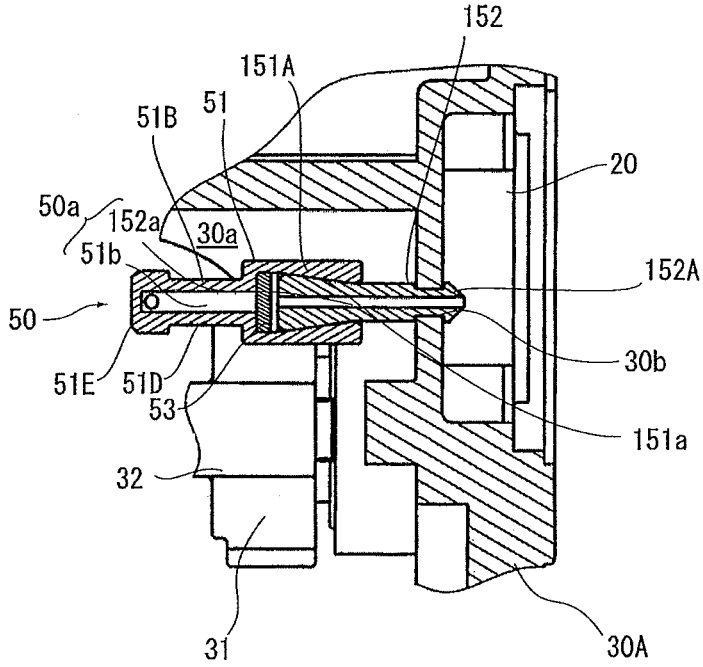
FIG. 9 is a cross-sectional view of an essential portion of a hammer drill according to a sixth modification to the embodiment of the present invention.

As shown in FIG. 9, a second passage forming component 152 may be provided independently of the gear housing 30. In this case, the gear housing 30 is formed with a mounting hole 30*b* for mounting a second passage forming component 152. The mounted portion 152A of the second passage forming component 152 is mounted on the mounting hole 30*b* to fix the second passage forming component 152 to the gear housing 30. Since a second passage 152*a* opens at the mounted portion 152A, the insertion and fixing of the mounted portion 152A to the mounting hole 30*b* allows the second passage 152*a* to communicate with the atmosphere. The second passage forming component 152 is configured to gradually enlarge its external dimension toward the leading end of the second passage forming component 152. On the other hand, the mounted section 151A of the first passage forming component 151 has an inner diameter of the holding space 151*a* that is gradually decreasing toward the rear end of the mounted section 151A. With this structure, the mounted section 151A is firmly engaged with the second passage forming component 152, thereby restraining the disengagement of the first passage forming component 151 from the second passage forming component 152. Since the second passage forming component 152 is provided independently of the gear housing 30, the manufacture of the gear housing 30 can be simplified. For example, if the gear housing 30 is produced by a casting, a casting die can be simplified. The second passage forming component 152 can be mounted on the gear housing 30 by forming the mounting hole 30*b* on a conventional gear housing.

Figure 10:
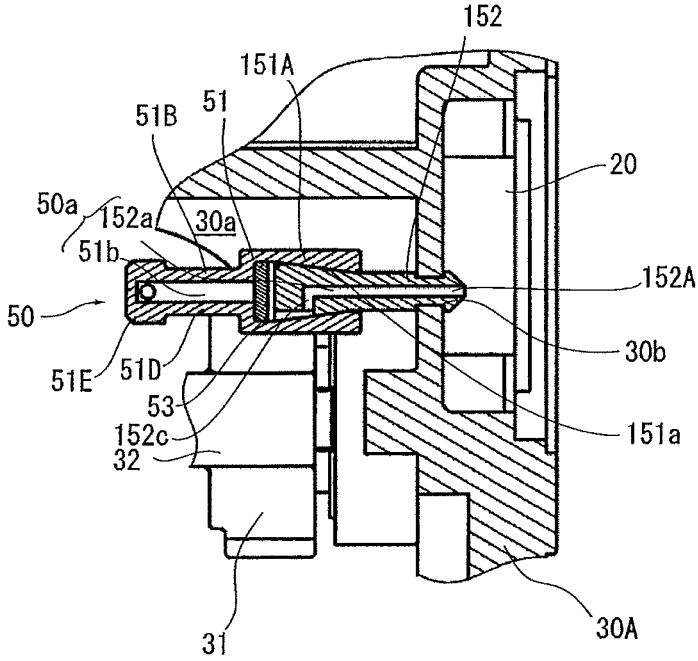
FIG. 10 is a cross-sectional view of an essential portion of a hammer drill according to a seventh modification to the embodiment of the present invention

A shown in FIG. 10, a bending passage 152*c* may be formed on the second passage forming component 152 in the same manner as the second passage forming component 52 shown in FIG. 8. With this structure, since the second passage forming component 152 is provided independently of the gear housing 30, the second passage 152*a* and the bending passage 152*c* can be easily formed.

Note that, the second passage forming component 152 shown in FIGS. 9 and 10 needs not to be made from metal similar to the support member 30A. For example, the second passage forming component 152 may be made from rubber material similar to the first passage forming component 51. Since the second passage forming component 152 is made from rubber material, the base section of the second passage forming component 152 is served as a fulcrum for the vibration of the pressure adjusting mechanism 50. Hence, the whole pressure adjusting mechanism 50 can be vibrated in the drilling operation. Accordingly, the grease adhered to the opening of the communication passage 50*a* that is located at the speed reduction chamber 30*a* side can be shook off more appropriately in comparison with a case where only the first passage forming component 51 vibrates. Further, if the second passage forming component 152 is made from rubber material, the first passage forming component 51 does not necessarily have to be made from rubber material. Further in the above embodiments, the power tool is the hammer drill 1. However, the present invention can be applied to the power tool having a structure that encloses the grease.

What is claimed is:

1. A power tool comprising:

a housing defining therein a mechanism chamber, a lubricant being inserted in an interior of the mechanical chamber;

an electric motor accommodated in the housing;

a speed change mechanism disposed in the mechanism chamber and connected to the motor for converting a rotary motion of the motor; and a protrusion member protruding to the interior of the mechanism chamber from an exterior of the mechanism chamber, the protrusion member providing a communication passage that has one opening open at a leading end side of the protrusion member and another opening open to the exterior of the mechanical chamber, wherein the protrusion member includes a first passage forming member located on the leading end side of the protrusion member, wherein the first passage forming member is formed with a first passage open to the interior of the mechanism chamber through the one opening, the first passage being one part of the communication passage, and wherein the first passage forming member is made from a resilient material.

2. The power tool as claimed in claim 1, wherein the protrusion member further includes a second passage forming member located at a base end side of the protrusion member, wherein the second passage forming member is formed with a second passage open to the exterior of the mechanism chamber and communicating with the first passage, the second passage being another part of the communication passage, and second passage being another part of the communication passage.

3. The power tool as claimed in claim 2, wherein the second passage forming member is formed integrally with the housing.

4. The power tool as claimed in claim 2, wherein the first passage forming member has a mounted section mounted on the second passage forming member and an extending section extending from the mounted section, the extending section being formed with an opening of the first passage that opens to the interior of the mechanism chamber, and wherein the extending portion is in a constriction shape with respect to the mounted section.

5. The power tool as claimed in claim 4, wherein the extending section has a cross-section perpendicular to an extending direction of the extending section, the cross-section of the extending section having an outer diameter that gradually increases toward a leading end side of the extending section in the extending direction.

6. The power tool as claimed in claim 1, wherein the first passage forming member has a first inner wall surface that defines the first passage having an inner diameter, and wherein the first inner wall surface is configured such that the inner diameter of the first passage gradually increases toward the leading end side of the protrusion member.

7. The power tool as claimed in claim 2, wherein the first passage forming member has a first inner wall surface that defines the first passage and the second passage forming member has a second inner wall surface that defines the second passage, and wherein at least one of the first inner wall and the second inner wall has annular projections and annular recesses alternately arrayed from the one opening to the another opening of the communication passage.

8. The power tool as claimed in claim 2, wherein the protrusion member further comprises an engagement portion through which the first passage forming member is engaged with the second passage forming member.

9. The power tool as claimed in claim 1, wherein the protrusion member includes a filter provided on the communication passage.

10. The power tool as claimed in claim 1, wherein the protrusion member is configured such that the communication passage has a bending section.

11. A power tool comprising:

a housing defining therein a mechanism chamber, a lubricant being inserted in an interior of the mechanical chamber;

an electric motor accommodated in the housing;

a speed change mechanism disposed in the mechanism chamber and connected to the motor for converting a rotary motion of the motor; and a protrusion member protruding to the interior of the mechanism chamber from an exterior of the mechanism chamber, the protrusion member providing a communication passage that has one opening open at a leading end side of the protrusion member and another opening open to the exterior of the mechanical chamber, at least a part of the protrusion member providing the communication passage and being made from a resilient material, wherein the protrusion member includes a first passage forming member located on the leading end side of the protrusion member and a second passage forming member located on a base end side of the protrusion member, wherein the first passage forming member is formed with a first passage open to the interior of the mechanism chamber through the one opening, the first passage being one part of the communication passage, wherein the second passage forming member is formed with a second passage open to the exterior of the mechanism chamber through the another opening and communicating with the first passage, the second passage being another part of the communication passage, wherein at least one of the first passage forming member and the second passage forming member is made from the resilient material, wherein the second passage forming member is formed independently of the housing, wherein the housing is formed with a mounting hole communicating the interior of the mechanism chamber with the exterior of the mechanism chamber, and wherein the second passage forming member has a mounted portion mounted on the mounting hole, the mounted portion being formed with an opening of the second passage.

12. The power tool as claimed in claim 11, wherein the first passage forming member is made from the resilient material and has a mounted section mounted on the second passage forming member and an extending section extending from the mounted section, the extending section being formed with an opening of the first passage that opens to the interior of the mechanism chamber, and wherein the extending portion is in a constriction shape with respect to the mounted section.

13. The power tool as claimed in claim 11, wherein the protrusion member further comprises an engagement portion through which the first passage forming member is engaged with the second passage forming member.

14. The power tool as claimed in claim 11, wherein the protrusion member includes a filter provided on the communication passage.

15. The power tool as claimed in claim 11, wherein the protrusion member is configured such that the communication passage has a bending section.

* * * * *